United States Patent [19]

Ichihashi et al.

[11] Patent Number: 4,875,501

[45] Date of Patent: Oct. 24, 1989

[54] ELECTROMAGNETIC PROPORTIONAL CONTROL VALVE APPARATUS

[75] Inventors: Kouji Ichihashi; Jun-ichi Yasuma, both of Higashimatsuyama, Japan

[73] Assignee: Diesel Kiki Co., Ltd., Tokyo, Japan

[21] Appl. No.: 333,081

[22] Filed: Apr. 4, 1989

[30] Foreign Application Priority Data

Apr. 20, 1988 [JP] Japan ..... 63-52185[U]

[51] Int. Cl.[4] ..... F15B 13/043

[52] U.S. Cl. ..... 137/625.64; 137/625.61; 251/36

[58] Field of Search ..... 137/625.61, 625.64; 251/36

[56] References Cited

U.S. PATENT DOCUMENTS 4,763,872 8/1988 Ichihashi et al. .

FOREIGN PATENT DOCUMENTS 62-110085 5/1987 Japan ..... 137/625.64

62-261782 11/1987 Japan .

*Primary Examiner*—Gerald A. Michalsky

[57] ABSTRACT

An electromagnetic proportional control valve apparatus comprises a valve body, a spool accommodated in a guide bore in the valve body, a valve seat element arranged at one end of the guide bore and facing toward the spool, a pilot valve controlling a valve bore in the valve seat element, and an electromagnetic drive unit for controlling the pilot valve. The spool has an axially extending axial bore formed in an end face opposed to the valve seat element, and a first restricting bore through which the axial bore communicates with the supply port. A projecting portion is formed on an end face of the valve seat element opposed to the spool, and is inserted in the axial bore in the spool. The projecting portion has a forward part formed therein with second restricting bores through which one end of the valve bore communicates with the axial bore. A restricting passage is defined between an outer peripheral surface of the projecting portion and an inner peripheral surface of the axial bore in the spool. A fluid accumulating chamber defined between opposed faces of the respective spool and valve seat element communicates with the axial bore in the spool through the restricting passage. Flow resistance at the restricting passage gives a damper effect to the spool.

6 Claims, 2 Drawing Sheets

ELECTROMAGNETIC PROPORTIONAL CONTROL VALVE APPARATUS

BACKGROUND OF THE INVENTION

The present invention relates to an electromagnetic proportional control valve apparatus which is operated by the utilization of pilot pressure.

A conventional electromagnetic proportional control valve apparatus of the kind referred to above comprises a valve body as disclosed in Japanese Patent Application Laid-Open (Provisional Publication) No. Sho 62-261782. The valve body is provided therein with a guide bore, and a supply port, a control port and a discharge port which are formed in a peripheral wall surrounding the guide bore. A spool is accommodated in the guide bore for sliding movement therein. A valve seat element is fixedly mounted to one end of the guide bore. A pilot chamber is defined between opposed end faces of the respective valve seat element and spool. The spool is abutted against the valve seat element under biasing force of a first return spring, in an unexcited state of electromagnetic drive means to be described later.

The end face of the spool, which is opposed to the valve seat element, is formed with an axial bore extending along an axis of the spool. A first restricting bore is formed in a peripheral wall surrounding the axial bore. The pilot chamber communicates with the supply port through the axial bore and the first restricting bore.

The valve seat element is formed therein with a valve bore, and a second restricting bore through which one end of the valve bore communicates with the pilot chamber. The other end of the valve bore has a peripheral edge which serves as a valve seat. A pilot valve is so arranged as to face toward the valve seat. During deenergization of the electromagnetic drive means to be described later, the pilot valve is spaced away from the valve seat under biasing force of a second return spring.

Electromagnetic drive means is arranged at an end of the valve body on the side of the valve seat element. When electric current is caused to pass through the electromagnetic drive means, force substantially in proportion to the current is given to the pilot valve, so that the pilot valve moves toward the valve seat against the biasing force of the second return spring. As a result, pilot pressure substantially in proportion to the current supplied to the electromagnetic drive means is produced in the pilot chamber due to pressure drop which occurs in an annular passage defined between the pilot valve and the valve seat, and due to pressure drop which occurs in the first and second restricting bores. By the pilot pressure, the spool is moved away from the valve seat element against the biasing force of the first return spring.

The spool has an outer periphery thereof which is formed with a land section for controlling communication between the control port and the supply port, and a land section for controlling communication between the control port and the discharge port. The spool moves such that force obtained by multiplication of the control-port pressure by a difference in pressure receiving area between both the lands is balanced with force due to the pilot pressure, thereby controlling communication among the ports. Thus, pressure at the control port is so controlled as to be substantially in proportion to the current supplied to the electromagnetic drive means.

In the electromagnetic proportional control valve apparatus constructed as above, the second restricting bore in the valve seat element bears such a role as to cause pressure drop occurring at the second restricting bore to bring pressure within the valve bore to a value lower than the pilot pressure, thereby enabling relatively low exciting force to control the relatively high pilot pressure. Further, the second restricting bore bears also such a role as to produce a damper effect on the spool. Specifically, when the spool moves, working fluid within the pilot chamber is caused to pass through the second restricting bore, and the moving speed of the spool is restrained low due to flow resistance which occurs at passage of the working fluid through the second restricting bore.

Assuming that there is no damper effect due to the second restricting bore, then there arises the following disadvantage. That is, the spool moves in response to fluctuation in the pilot pressure attendant upon fluctuation in the electric current supplied to the electromagnetic drive means, or in response to fluctuation in the control-port pressure, to control communication between the control port and the supply port and/or the tank port. Because of inertia of the spool at its movement, however, the spool passes largely over an optimum position, so that the balance between the control-port pressure and the pilot pressure is broken. Accordingly, the spool moves in the reverse direction. Also at the movement in the reverse direction, the spool passes largely over the optimum position because of inertia of the spool. Such repetition of reciprocative movement of the spool, that is, hunting makes the control unstable. Further, when the current supply to the electromagnetic drive means is halted, the pilot valve is moved away from the valve seat so that the pilot pressure is reduced. Following the reduction in the pilot pressure, the spool is returned toward the valve seat element from a position where the spool controls the pressure at the control port. At this time, the spool impinges against the valve seat element at high speed.

In the control valve apparatus disclosed in the aforesaid Japanese patent, the damper effect on the spool occurring due to the second restricting bore formed in the valve seat prevents the spool from impinging against the valve seat element at high speed, and prevents the spool from hunting.

Particularly, high damper effect is required when the pressure at the control port is high. This damper effect can be enhanced by reducing the opening area of the second restricting bore to increase the flow resistance of the working fluid. Further, since the viscosity resistance of the working fluid is reduced when the control valve apparatus is used under high-temperature environment, it is desired to further reduce the opening area of the second restricting bore.

However, the opening area of the second restricting bore in the valve seat element cannot be reduced freely for the reason discussed below. That is, if the opening area of the second restricting bore is reduced, the flow resistance at the second restricting bore makes it difficult that the pilot pressure within the pilot chamber escapes to the atmosphere through the second restricting bore, when the current supplied to the electromagnetic drive means is reduced or is brought to zero to thereby move the pilot valve away from the valve seat. Thus, it takes a considerable time to lower the pressure at the control port in response to lowering or halt of the supply current.

It has been difficult to determine the opening area or the flow resistance of the second restricting bore so as to sufficiently satisfy both the damper effect and the response.

Additionally, U.S. Pat. No. 4,763,872 discloses an electromagnetic proportional control valve apparatus which has no second restricting bore.

SUMMARY OF THE INVENTION

It is an object of the invention to provide an electromagnetic proportional control valve apparatus capable of sufficiently satisfying both damper effect and response.

According to the invention, there is provided an electromagnetic proportional control valve apparatus comprising:

(a) a valve body having a guide bore extending straight, and a supply port, a control port and a discharge port which communicate with the guide bore;

(b) a spool accommodated in the guide bore in the valve body for axial sliding movement in the guide bore, wherein the spool has a pair of land sections spaced axially from each other, wherein one of the pair of land sections controls communication between the supply port and the control port in accordance with a position of the spool, while the other land section controls communication between the control port and the discharge port, and wherein the spool has an axially extending axial bore formed in one end face of the spool, and first restricting bore means through which the axial bore communicates with the supply port;

(c) a valve seat element arranged in facing relation to the one end face of the spool to close the guide bore, the valve seat element being formed with a projecting portion at one end face of the valve seat element which is opposed to the spool, the projecting portion being inserted in the axial bore in the spool, wherein a restricting passage is defined between an outer peripheral surface of the projecting portion and an inner peripheral surface of the axial bore in the spool, wherein the valve seat element has an axially extending valve bore, and second restricting bore means formed in a forward part of the projecting portion, the valve bore having one end thereof communicating with the axial bore through the second restricting bore means, wherein the other end of the valve bore has a peripheral edge serving as a valve seat, wherein a fluid accumulating chamber is defined between the one end face of the spool and the one end face of the valve seat element, the fluid accumulating chamber being arranged about the projecting portion of the valve seat element, and wherein the fluid accumulating chamber communicates with the axial bore in the spool through the restricting passage defined between the projecting portion and the spool;

(d) a pilot valve arranged in facing relation to the valve seat; and (e) electromagnetic drive means arranged at one end of the valve body for controlling the pilot valve.

DETAILED DESCRIPTION

Figure 1:
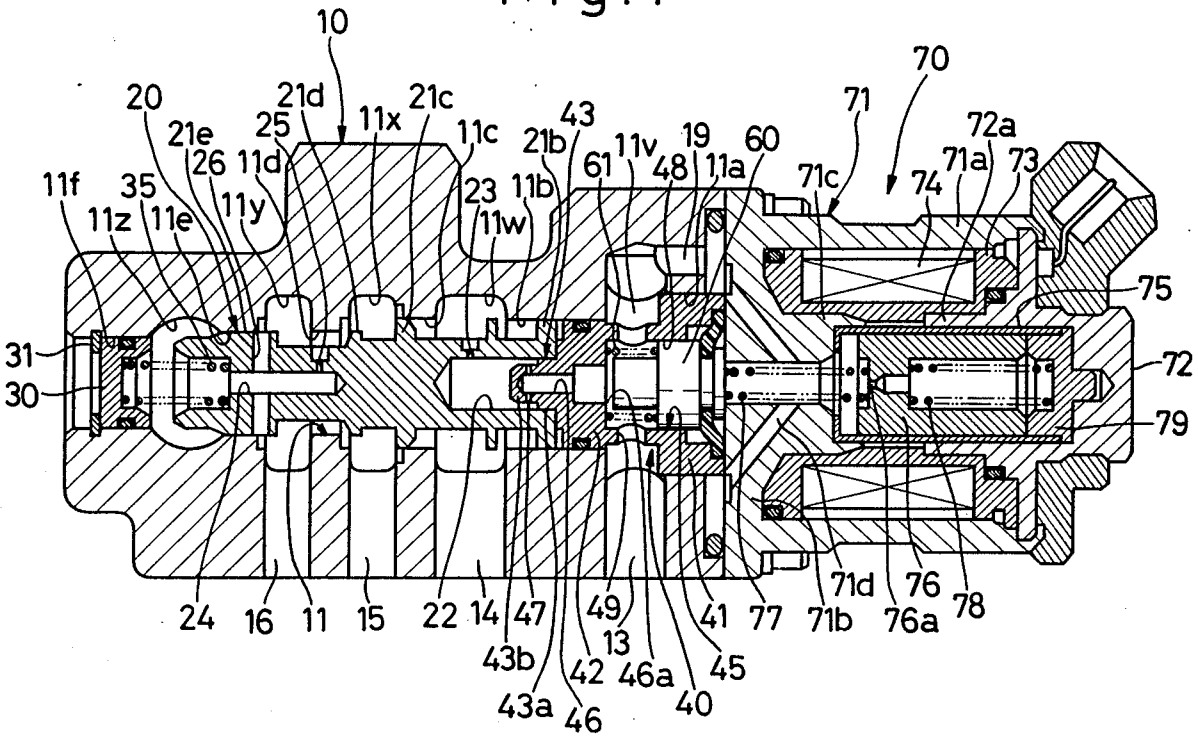
FIG. 1 is a cross-sectional view of an electromagnetic proportional control valve apparatus according to an embodiment of the invention.
Figure 2:
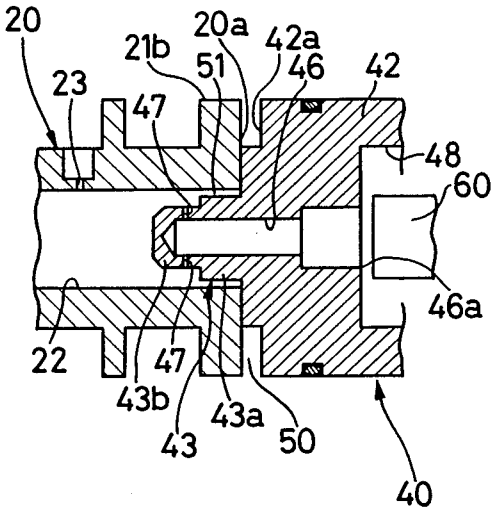
FIG. 2 is an enlarged fragmentary cross-sectional view showing a spool and a valve seat element of the electromagnetic proportional control valve apparatus illustrated in FIG. 1.

Referring first to FIGS. 1 and 2, there is shown an electromagnetic proportional control valve apparatus according to an embodiment of the invention.

As shown in FIG. 1, the electromagnetic proportional control valve apparatus comprises a valve body 10. The valve body 10 is formed therein with a guide bore 11 which extends straight through the valve body 10 from a right-hand end face to a left-hand end face thereof. The guide bore 11 is provided with six peripheral surface sections 11*a*, 11*b*, 11*c*, 11*e* and 11*f* in order from the right, which are divided by five annular grooves 11*v*, 11*w*, 11*x*, 11*y* and 11*z*. The peripheral surface sections 11*b* and 11*c* are equal in diameter to each other. The peripheral surface sections 11*b* and 11*c* are smaller in diameter than the peripheral surface section 11*a*, but larger in diameter than the peripheral surface sections 11*d*, 11*e* and 11*f*.

A peripheral wall of the valve body 10, which surrounds the guide bore 11, is formed therein with a drain port 13, a supply port 14, a control port 15 and a tank port 16 serving as a discharge port, in order from the right, which extend radially. The ports 13, 14, 15 and 16 have their respective inward ends which communicate with the annular grooves 11*v*, 11*w*, 11*x* and 11*y*, respectively. The drain port 13 and the tank port 16 have their respective outward ends which are connected to a tank (not shown). Further, the supply port 14 has its outward end which is connected to a fluid-pressure supply source (not shown) such as a hydraulic pump or the like. The control port 15 has its outward end which is connected to an actuator (not shown) of a clutch.

A spool 20 is accommodated in the guide bore for axial sliding movement therein. The spool 20 has its outer peripheral surface which is formed with land sections 21*b*, 21 *c*, 21*d* and 21*e* in order from the right. The right-hand two land sections 21*b* and 21*c* are equal in diameter to each other, and are larger in diameter than the left-hand two land sections 21*d* and 21*e*.

The land section 21*b* of the spool 20 is always in contact with the peripheral surface section 11*b* of the guide bore 11 which is located between the drain port 13 and the supply port 14. The land section 21*c* can be brought into contact with and can be separated from the peripheral surface section 11*c* of the guide bore 11 located between the supply port 14 and the control port 15, depending upon the position of the spool 20, thereby controlling communication between the supply port 14 and the control port 15. The land section 21*d* can be brought into contact with and can be separated from the peripheral surface section 11*d* of the guide bore 11 located between the control port 15 and the tank port 16, depending upon the position of the spool 20, thereby controlling communication between the control port 15 and the tank port 16. The land section 21*e* is always in contact with the peripheral surface section 11*e* of the guide bore 11 located on the left-hand side of the tank port 16.

The spool 20 has its right-hand end face which is formed with an axial bore 22 extending along an axis of the spool 20. A peripheral wall surrounding the axial bore 22 is formed therein with a first restricting bore 23 through which the axial bore 22 communicates with the supply port 14. The axial bore 22 serves as a pilot chamber at which pilot pressure is produced to be described later.

The spool 20 has its left-hand end face which is formed with a stepped axial bore 24 extending along the axis of the spool 20. A peripheral wall surrounding the axial bore 24 is formed therein with an auxiliary restricting bore 25 and a lateral bore 26 through which the axial bore 24 communicates with the tank port 16.

A closure 30 is fitted in the peripheral surface section 11*f* of the guide bore 11 at the left-hand end thereof, and is retained in position by a ring 31. A first return spring 35 is accommodated under compression in a chamber defined between the closure 30 and the spool 20. Under the biasing force of the first return spring 35, the spool 20 is biased toward the right as viewed in FIG. 1, that is, toward a valve seat element 40 subsequently to be described.

The above-described valve seat element 40 is inserted in the right-hand end portion of the guide bore 11. The valve seat element 40 is provided with a large-diameter inserting section 41 and a small-diameter inserting section 42. The large-diameter inserting section 41 is fitted in the peripheral surface section 11*a* of the guide bore 11 at the right-hand end thereof. The small-diameter inserting section 42 is fitted in a liquid-tight fashion in a right-hand end portion of the peripheral surface section 11*b* of the guide bore 11.

An axially extending projecting portion 43 is formed at the center of a face of the small-diameter inserting section 42 which is opposed to the spool 20. The projecting portion 43 is provided, at its base end, with a large-diameter part 43*a* and, at a forward end, with a small-diameter part 43*b*. The large-diameter part 43*a* has its outer diameter which is slightly smaller than the inner diameter of the axial bore 22. The projecting portion 43 is inserted in the axial bore 22 in the spool 20 in such a state that the spool 20 is abutted against the valve seat element 40. In such state, an annular gap 51, which has a narrow width and which serves as a restricting passage as exaggeratedly shown in FIG. 2, is defined between the outer peripheral surface of the large-diameter part 43*a* of the projecting portion 43 and the inner peripheral surface of the axial bore 22.

A fluid accumulating chamber 50 is defined between the end face of the spool 20 and a stepped end face portion 42*a* of the small-diameter inserting section 42 which is located around the projecting portion 43. The fluid accumulating chamber 50 communicates with the axial bore 22 in the spool 20 through the gap 51.

The valve seat element 40 is formed therein with a stepped axial bore 45 which extends along the axis of the valve seat element 40 and which opens at the right-hand end face of the valve element 40. The axial bore 45 has its left-hand end portion which is formed into a stepped valve bore 46. The valve bore 46 communicates with the axial bore 22 in the spool 20 through second restricting bores 47 which are formed in a peripheral wall of the small-diameter part 43*b* of the projecting portion 43. Further, the valve bore 46 has its right-hand end whose peripheral edge serves as a valve seat 46*a*.

The axial bore 45 in the valve seat element 40 has a central section which is formed into a guide bore 48 for a pilot valve 60 subsequently to be described. A peripheral wall surrounding the guide bore 48 is formed therein with a lateral bore 49 through which the guide bore 48 communicates with the drain port 13.

The above-mentioned pilot valve 60 is accommodated in the guide bore 48 in the valve seat element 40 for sliding movement in the guide bore 48. The pilot valve 60 has its small-diameter forward end which can be brought into contact with and be separated from the valve seat 46*a*.

A second return spring 61 is accommodated under compression in the guide bore 48 in the valve seat element 40. Under the biasing force of the second return spring 61, the pilot valve 60 is biased toward the right.

Electromagnetic drive means 70 is arranged at the right-hand end of the valve body 10. The electromagnetic drive means 70 has a housing 71 which is made of magnetic material and which is fixedly mounted to the valve body 10. The housing 71 is composed of a tubular section 71*a*, an end wall section 71*b* formed at a left-hand end of the tubular section 71*a*, and an inner tubular section 71*c* formed at the center of the end wall section 71*b*. A stator 72 made of magnetic material is mounted to the right-hand end of the tubular section 71*a* of the housing 71. The stator 72 has at its center an inner tubular section 72*a*. A solenoid 74 is arranged within the housing 71. Specifically, the solenoid 74 is arranged around the outer periphery of the inner tubular section 71*c* of the housing 71 and the outer periphery of the inner tubular section 72*a* of the stator 72. The solenoid 74 is retained in position by a bobbin 73 made of non-magnetic material. A guide tube 75 is fitted in the inner peripheries of the respective inner tubular sections 71*c* and 72*a*. Accommodated in the guide tube 75 for axial sliding movement is a tubular armature 76 formed therein with an orifice 76*a*. A stopper 79 for the armature 76 is arranged at the right-hand end of the guide tube 75.

A spring 77, which has a high spring modulus and which has substantially a natural length, is interposed between the armature 76 and the pilot valve 60. By the spring 77, the exciting force of the solenoid 74 given to the armature 76 is transmitted to the pilot valve 60. In this connection, the armature 76 is biased to the left lightly by a spring 78 in order to eliminate shakiness or ricketiness of the armature 76.

A space within the guide tube 75 communicates with the annular groove 11*v* through a passage 19 formed in the valve body 10 and passages 71*d* formed in the housing 71, whereby the interior of the guide tube 75 is filled with working fluid. A damper effect on the armature 76 is obtained by flow resistance at the time the working fluid is passed through the orifice 76*a* in the armature 76.

In the electromagnetic proportional control valve apparatus constructed as above, the pilot valve 60 is in its initial position in such a state that no current is passed through the solenoid 74. That is, the pilot valve 60 is abutted against the left-hand end face of the end wall section 71*b* of the housing 71 under the biasing force of the second return spring 61. Further, the armature 76 is also in its initial position. That is, the armature 76 receives the biasing force of the second return spring 61 through the pilot valve 60 and the spring 77, so that the armature 76 is abutted against the stopper 79.

When the pilot valve 60 is in its initial position as described above, the pressure at the valve bore 46 is low, because the cross-sectional flow area between the pilot valve 60 and the valve seat 46*a* is large. Accordingly, pilot pressure within the axial bore 22, which communicates with the valve bore 46 through the second restricting bores 47, is also low. Therefore, the spool 20 is abutted against the valve seat element 40 under the biasing force of the first return spring 35, so that the spool 20 is in its initial position.

When the spool 20 is in its initial position, the land section 21c of the spool 20 is in contact with the peripheral surface section 11c of the guide bore 11, so that the control port 15 is isolated from the supply port 14. Since, further, the land section 21d is spaced away from the peripheral surface section 11d, the control port 15 communicates with the tank port 16. Accordingly, the pressure at the control port 15 is brought to the pressure at the tank port 16, that is, substantially to the atmospheric pressure.

When the direct current flows through the solenoid 74, magnetic force to the left substantially in proportion to the current is given to the armature 76. This force is transmitted to the pilot valve 60 through the spring 77. As a result, the armature 76 and the pilot valve 60 move to the left against the biasing force of the second return spring 61. By this movement of the pilot valve 60, the cross-sectional flow area between the pilot valve 60 and the valve seat 46a is reduced, so that the pressure at the valve bore 46 rises. This raises the pilot pressure at the axial bore 22 in the spool 20. The pilot valve 60 stops at a position where the force to the right due to the pressure within the valve bore 46 is balanced with the force to the left due to the solenoid 74. As a result, the pilot pressure within the axial bore 22 is so controlled as to be substantially in proportion to the current supplied to the solenoid 74.

In the stop or stationary state of the pilot valve 60, the pressure at the valve bore 46 is higher than the pressure at the drain port 13, that is, than the atmospheric pressure by an amount corresponding to pressure drop between the pilot valve 60 and the valve seat 46a. Further, the pilot pressure within the axial bore 22 is higher than the pressure within the valve bore 46 by an amount corresponding to pressure drop at the second restricting bores 47, but is lower than the pressure at the supply port 14 by an amount corresponding to pressure drop at the first restricting bore 23.

In connection with the above, since the pressure at the valve bore 46 is lower than the pilot pressure because of the pressure drop at the second restricting bores 47, the relatively high pilot pressure can be controlled by the relatively low exciting force, making it possible for the electromagnetic proportional control valve apparatus to execute stable control.

As described above, when the pilot pressure rises in response to the current supplied to the solenoid 74, the force to the left acting upon the spool 20 due to the pilot pressure overcomes the biasing force of the first return spring 35, so that the spool 20 moves to the left. As a result, the land section 21c is separated from the peripheral surface section 11c of the guide bore 11, so that the control port 15 and the supply port 14 are brought into communication with each other. When the spool 20 moves further to the left slightly, the land section 21d is brought into contact with the peripheral surface section 11d, so that the control port 15 is isolated from the tank port 16. Accordingly, the pressure at the control port 15 rises.

Finally, the spool 20 stops at a position where the force to the right obtained by multiplication of the pressure at the control port 15 by the difference in pressure receiving area between the land sections 21c and 21d is balanced with the force to the left given to the spool 20 due to the pilot pressure. As a result, the pressure at the control port 15 is so controlled as to be in proportion to the current supplied to the solenoid 74.

In connection with the above, the stop position of the spool 20 is within such a stroke (hereinafter referred to as "control region") that both the land sections 21c and 21d are out of contact with the respective peripheral surface sections 11c and 11d of the guide bore 11. In this stop state of the spool 20, when the current supplied to the solenoid 74 increases, or when the pressure at the control port 15 is reduced for some reason, the balance between the right- and left-hand forces acting upon the spool 20 is broken temporarily, so that the spool 20 moves slightly to the left, whereby the pressure at the control port 15 is raised. In the reverse case, the spool 20 moves slightly to the right to lower the pressure at the control port 15.

At movement of the spool 20, the working fluid flows into the fluid accumulating chamber 50 from the axial bore 22, or into the axial bore 22 from the fluid accumulating chamber 50 through the gap 51 defined between the inner peripheral surface of the axial bore 22 in the spool 20 and the outer peripheral surface of the large-diameter part 43a of the valve seat element 40. By the damper effect due to the flow resistance of the working fluid at the gap 51, the moving speed of the spool 20 is restrained low. As a result, excessive response of the spool 20 is eliminated, making it possible to prevent hunting. Thus, the control can be executed in a stable manner.

When the supply of the current to the solenoid 74 is halted, the pilot valve 60 is separated from the valve seat 46a by the pressure at the valve bore 46, to lower the pressure at the valve bore 46. When the pressure at the valve bore 46 is lowered, the pilot pressure at the axial bore 22 in the spool 20 escapes through the second restricting bore 47, so that the pilot pressure is also lowered. When the pilot pressure is lowered, the spool 20 moves to the right by the residual pressure at the control port 15. Also at this movement of the spool 20, the damper effect due to the flow resistance of the working fluid at the gap 51 enables the spool 20 from impinging against the valve seat element 40 at high speed.

As will be clear from the above description, the axial length of the large-diameter part 43a of the projecting portion 43 is determined in such a manner that, even if the spool 20 moves from its initial position to the left by at least an amount corresponding to the stroke including the aforementioned control region, the gap 51 still exists or remains, in order to prevent the spool 20 from impinging against the valve seat element 40 at high speed and in order to prevent hunting of the spool 20.

As described above, the gap 51 between the inner peripheral surface of the axial bore 22 and the outer peripheral surface of the large-diameter part 43a of the valve seat element 40 bears such a role as to generate the damper effect. Thus, it is possible to relieve or eliminate the role generating the damper effect, which is born by the second restricting bores 47 in the valve seat element 40. Therefore, the total opening area of the second restricting bores 47 can be increased more than that of the conventional restricting bore. Accordingly, when the pressure at the valve bore 46 lowers in response to a decrease in the current supplied to the solenoid 74, the pilot pressure within the axial bore 22 can escape relatively quickly or rapidly to the valve bore 46 through the second restricting bores 47. Thus, the spool 20 can be moved to the right relatively quickly, making it possible to quickly reduce the pressure at the control port 15 to pressure corresponding to the supply current. When, for example, the supply of current to the solenoid 74 is halted, the pressure at the control port can be returned to the atmospheric pressure for a relatively short period of time. As a result, it is possible to enhance the response of the electromagnetic proportional control valve apparatus.

In connection with the above, when the spool 20 moves to the left by a predetermined distance, the lateral bore 26 in the spool 20 is closed by the peripheral surface section 11*e* of the guide bore 11. Therefore, the flow resistance of the working fluid at the auxiliary restricting bore 25 enables the damper effect to be given to the spool 20, making it possible to prevent the spool 20 from moving excessively to the left.

Figure 3:
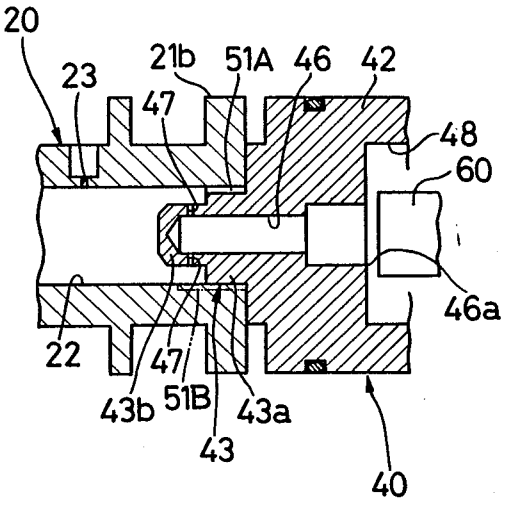
FIG. 3 is a view similar to FIG. 2, but showing another embodiment of the invention.

FIG. 3 shows another embodiment of the invention. In FIG. 3, component parts like or similar to those illustrated in FIG. 2 are designated by the same or like reference numerals, and the detailed description of such like or similar component parts will therefore be omitted to avoid repetition. In the embodiment illustrated in FIG. 3, the large-diameter part 43*a* of the projecting portion 43 of the valve seat element 40 has an outer diameter which is substantially equal to the inner diameter of the axial bore 22 in the spool 20 so that the gap 51 illustrated in FIG. 2 is eliminated. In place of this gap 51, an axially extending groove 51A is formed in the outer peripheral surface of the large-diameter part 43*a*. The groove 51A serves as a restricting passage. In this connection, as indicated by the double-dotted line in FIG. 3, an axially extending groove 51B may be formed in the inner peripheral surface of the axial bore 22 in the spool 20, in place of the groove 51A or in addition to the groove 51A.

It is to be understood that the invention is not limited to the above-described embodiments but any suitable changes and modifications may be made to the invention. For instance, the projecting portion of the valve seat element may not be formed with the small-diameter part, but the second restricting bore may be formed at the center of the forward end face of the projecting portion.

The end face of the valve seat element, which is opposed to the spool, may not be formed with the step around the projecting portion, but may be a planar face. In this case, in a state in which the spool is abutted against the valve seat element, the volume of the fluid accumulating chamber defined between the spool and the valve seat element is brought substantially to zero.

Furthermore, the arrangement may be such that, in a relatively short region of the stroke of the spool, the two land sections on the spool are simultaneously brought into contact respectively with the peripheral surface section of the guide bore between the control port and the supply port and the peripheral surface section of the guide bore between the control port and the tank port, whereby the control port is isolated from both the supply port and the tank port.

What is claimed is:

1. An electromagnetic proportional control valve apparatus comprising:

(a) a valve body having a guide bore extending straight, and a supply port, a control port and a discharge port which communicate with said guide bore;

(b) a spool accommodated in said guide bore in said valve body for axial sliding movement in said guide bore, wherein said spool has a pair of land sections spaced axially from each other, wherein one of said pair of land sections controls communication between said supply port and said control port in accordance with a position of said spool, while the other land section controls communication between said control port and said discharge port, and wherein said spool has an axially extending axial bore formed in one end face of said spool, and first restricting bore means through which said axial bore communicates with said supply port;

(c) a valve seat element arranged in facing relation to said one end face of said spool to close said guide bore, said valve seat element being formed with a projecting portion at one end face of said valve seat element which is opposed to said spool, said projecting portion being inserted in said axial bore in said spool, wherein a restricting passage is defined between an outer peripheral surface of said projecting portion and an inner peripheral surface of said axial bore in said spool, wherein said valve seat element has an axially extending valve bore, and second restricting bore means formed in a forward part of said projecting portion, said valve bore having one end thereof communicating with said axial bore through said second restricting bore means, wherein the other end of said valve bore has a peripheral edge serving as a valve seat, wherein a fluid accumulating chamber is defined between said one end face of said spool and said one end face of said valve seat element, said fluid accumulating chamber being arranged about said projecting portion of said valve seat element, and wherein said fluid accumulating chamber communicates with said axial bore in said spool through said restricting passage defined between said projecting portion and said spool;

(d) a pilot valve arranged in facing relation to said valve seat; and (e) electromagnetic drive means arranged at one end of said valve body for controlling said pilot valve.

2. An electromagnetic proportional control valve apparatus comprising;

(a) a valve body having a guide bore extending straight and, a supply port, a control port and a discharge port formed in order from one end toward the other end of said valve body, wherein said supply port, said control port and said discharge port communicate with said guide bore, and wherein said guide bore has a first peripheral surface section located between said supply port and said one end of said valve body, a second peripheral surface section located between said supply port and said control port, and a third peripheral surface section located between said control port and said discharge port;

(b) a spool accommodated in said guide bore for axial sliding movement therein, said spool being formed with first, second and third land sections in order from said one end toward the other end of said valve body, said first land section being in contact with said first peripheral surface section, wherein when said second land section is brought into contact with said second peripheral surface section of said guide bore, said supply port and said control port are isolated from each other, while when said second land section is separated from said second peripheral surface section, said supply port and said control port are brought into communication with each other, wherein when said third land section is brought into contact with said third peripheral surface section, said control port and said discharge port are isolated from each other, while when said third land section is separated from said third peripheral surface section, said control port and said discharge port are brought into communication with each other, wherein said second land section is larger in diameter than said third land section, wherein said second and third land sections have their respective faces opposed to each other, to which pressure at said control port is applied, and wherein said spool has an axial bore extending along an axis of said spool and formed in an end face of said spool which is located at said one end of said valve body, and first restricting bore means through which said axial bore and said supply port communicate with each other;

(c) a valve seat element fixedly mounted to said one end of said valve body to close said guide bore, said valve seat element having a projecting portion formed on an end face of said valve seat element which is opposed to said spool, said projecting portion being inserted in said axial bore in said spool, wherein a restricting passage is defined between an outer peripheral surface of said projecting portion and an inner peripheral surface of said axial bore in said spool, wherein said valve seat element has an axially extending valve bore, and second restricting bore means formed in a forward part of said projecting portion, said valve bore having one end thereof which communicates with said axial bore through said second restricting bore means, wherein said valve bore has the other end whose peripheral edge serves as a valve seat, wherein a fluid accumulating chamber is defined between said end face of said valve seat element and said end face of said spool, which are opposed to each other, said fluid accumulating chamber being located about said projecting portion of said valve seat element, and wherein said fluid accumulating chamber communicates with said axial bore in said spool through said restricting passage defined between said projecting portion and said spool;

(d) a pilot valve arranged in facing relation to said valve seat; and (e) electromagnetic drive means arranged at said one end of said valve body, wherein when electric current is supplied to said electromagnetic drive means, magnetic force is generated by said electromagnetic drive means, wherein said pilot valve is moved in response to said magnetic force so that pilot pressure within said axial bore in said spool is so controlled as to be substantially in proportion to the electric current supplied to said electromagnetic drive means, and wherein said spool moves such that force due to said pilot pressure is balanced with force due to the pressure at said control port applied to said second and third land sections of said spool, whereby the pressure at said control port is so controlled as to be substantially in proportion to said electric current supplied to said electromagnetic drive means.

3. An electromagnetic proportional control valve apparatus according to claim 2, wherein said projecting portion of said valve seat element is provided, at its base end, with a large-diameter part and, at a forward end, with a small-diameter part, wherein said restricting passage is defined between an outer peripheral surface of said large-diameter part and the inner peripheral surface of said axial bore in said spool, and wherein said second restricting bore means is formed in said small-diameter section.

4. An electromagnetic proportional control valve apparatus according to claim 2, wherein said restricting passage is formed by an annular gap defined between the outer peripheral surface of said projecting portion of said valve seat element and the inner peripheral surface of said axial bore in said spool.

5. An electromagnetic proportional control valve apparatus according to claim 2, wherein said restricting passage is a groove formed in at least one of the outer peripheral surface of said projecting portion of said valve seat element and the inner peripheral surface of said axial bore in said spool.

6. An electromagnetic proportional control valve apparatus according to claim 5, wherein said groove serving as said restricting passage extends axially.

* * * * *